United States Patent [19]

Sakaguchi et al.

[11] Patent Number: 4,694,885

[45] Date of Patent: Sep. 22, 1987

[54] APPARATUS FOR CONTINUOUS CASTING OF THIN METALLIC PLATE

[75] Inventors: Haruo Sakaguchi; Teruyoshi Suehiro; Kunio Nagai, all of Osaka; Toshie Hashimoto, Izumi; Hisaki Nishiyama, Toyonaka; Masakazu Mohri, Takatsuki, all of Japan

[73] Assignee: Hitachi Zosen Corporation, Osaka, Japan

[21] Appl. No.: 857,921

[22] Filed: Apr. 30, 1986

[30] Foreign Application Priority Data

| | | | |
|---|---|---|---|
| Jun. 6, 1985 | [JP] | Japan | 60-123197 |
| Jun. 6, 1985 | [JP] | Japan | 60-123198 |
| Jul. 17, 1985 | [JP] | Japan | 60-157272 |
| Sep. 4, 1985 | [JP] | Japan | 60-195191 |

[51] Int. Cl.[4] ..... B22D 11/06

[52] U.S. Cl. ..... 164/416; 164/427; 164/429; 164/437

[58] Field of Search ..... 164/154, 155, 416, 423, 164/427, 428, 429, 437, 438, 439, 452, 463, 478, 479, 480, 488

[56] References Cited

U.S. PATENT DOCUMENTS

| | | | |
|---|---|---|---|
| 2,348,178 | 5/1944 | Merle | 164/429 |

FOREIGN PATENT DOCUMENTS

| | | | |
|---|---|---|---|
| 0066118 | 12/1982 | European Pat. Off. | 164/437 |
| 59-215256 | 12/1984 | Japan | 164/480 |
| 60-21158 | 2/1985 | Japan | 164/437 |

*Primary Examiner*—Nicholas P. Godici
*Assistant Examiner*—Richard K. Seidel
*Attorney, Agent, or Firm*—Joseph W. Farley

[57] ABSTRACT

An apparatus for continuous casting of a thin metallic plate which includes a movable mold 2 arranged for movement in a specified direction, and a melt receiver 5 disposed on the movable mold 2 for storing molten metal in coopertion therewith, whereby molten metal within the melt receiver 5, through its contact with the surface of the movable mold 2, will be cooled and formed into a casting shell, the casting shell being drawn by the movable mold 2 in the form of a thin metallic plate, wherein at least the lower end portion of the melt receiver 5 is movable along the withdrawal path of the casting shell, and wherein a mover mechanism 7 is provided for moving the lower end portion of the melt receiver 5.

10 Claims, 34 Drawing Figures

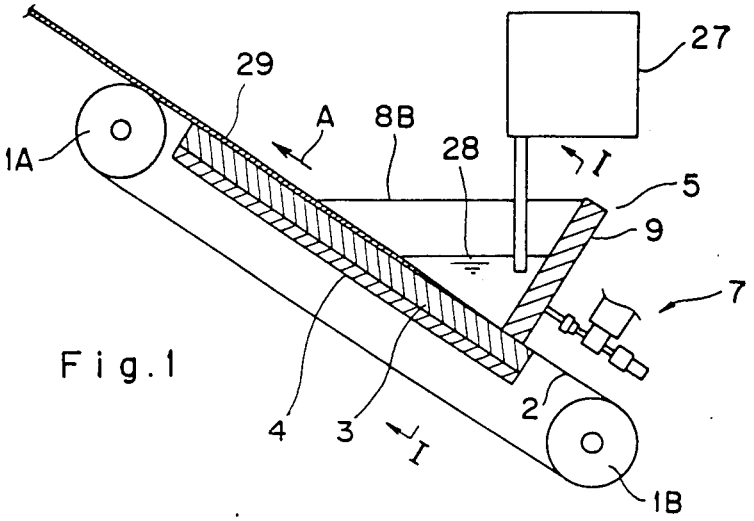
Fig.1
Fig.2
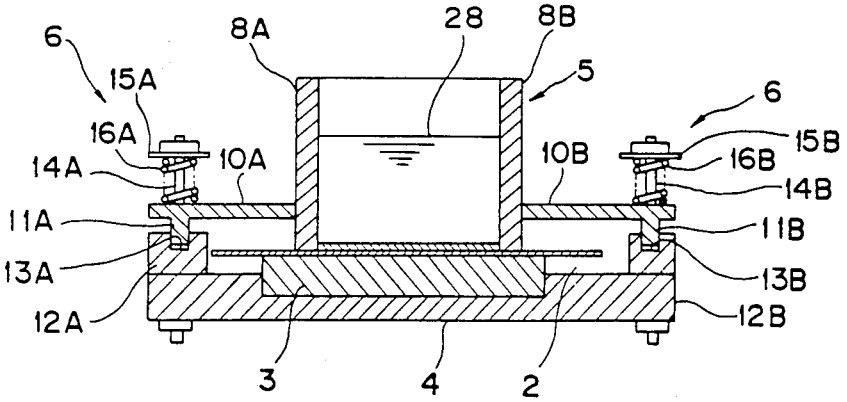
Fig.3
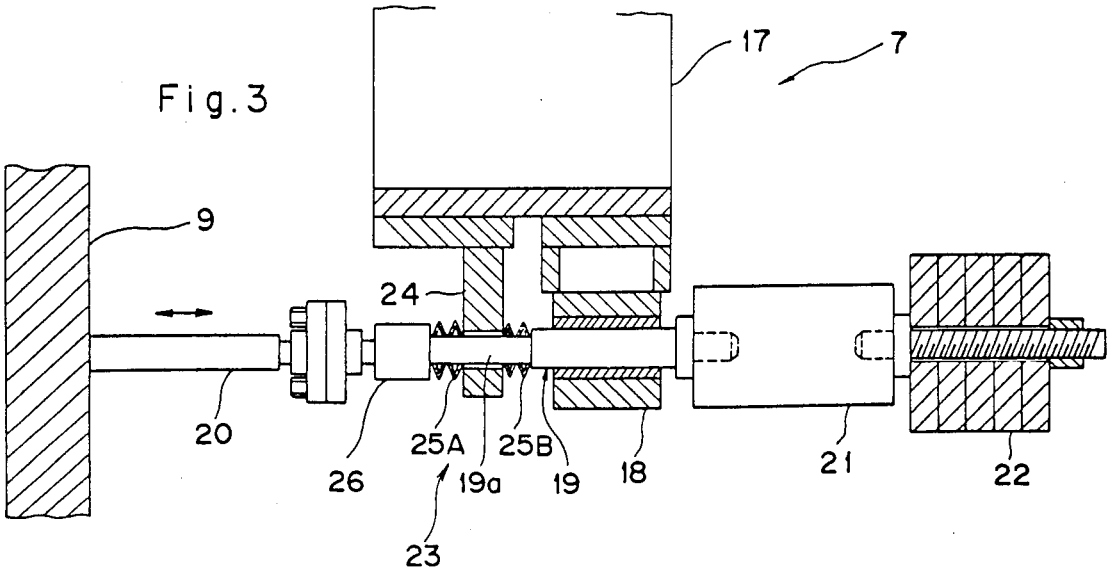

Fig. 28
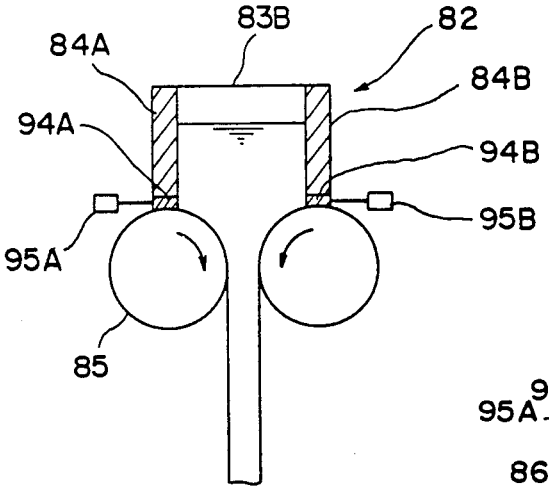
Fig. 27
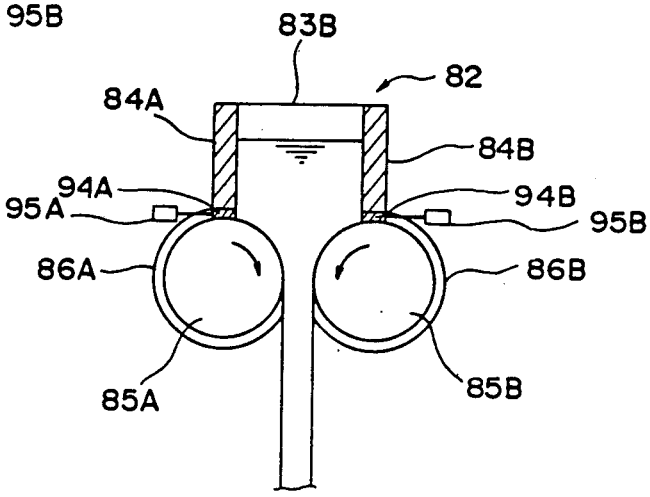
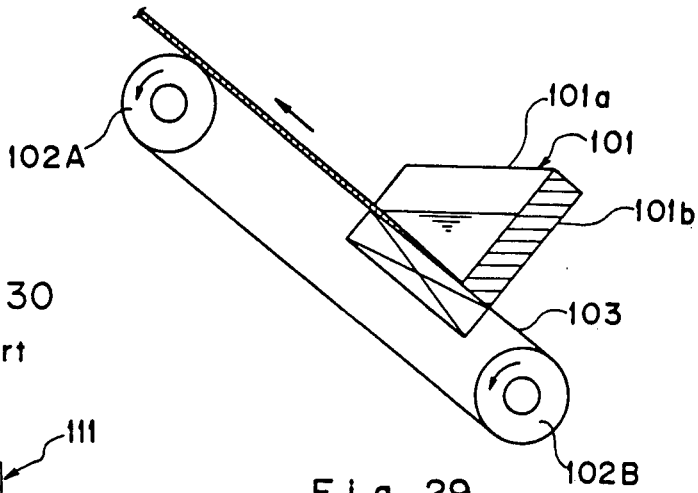
Fig. 29
Prior Art
Fig. 30
Prior Art
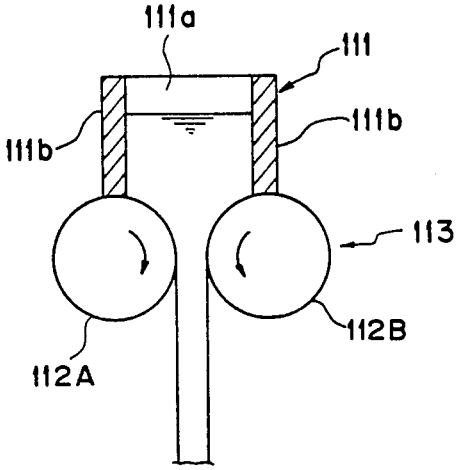

APPARATUS FOR CONTINUOUS CASTING OF THIN METALLIC PLATE

FIELD OF THE INVENTION

The present invention relates to an apparatus for continuous casting of a thin metallic plate, wherein molten metal within a melt receiver disposed on a movable mold is continuously drawn by the movable mold in the form of a thin plate-like casting as the molten metal is solidified.

BACKGROUND OF THE INVENTION

Conventionally, movable molds are employed in continuous casting of thin metallic plates. Two types of such molds are known: one for drawing a casting in a generally horizontal direction, and the other for drawing a casting in a vertical direction. The former, as FIG. 29 illustrates, is a belt-type movable mold 103 positioned under a melt receiver 101 and endlessly trained around a pair of drive rollers 102A, 102B, front and rear, in a longitudinally inclined condition. Molten metal within the receiver 101 is drawn in the form of a thin plate-like casting sequentially as it is cooled and solidified on the surface of the belt-type mold 103. A movable mold of the latter type, as FIG. 30 shows, is a twin-roll type mold 113 wherein molten metal is drawn through a clearance defined between a pair of rolls 112A, 112B disposed under a melt receiver 111 and is then solidified in the form of a thin plate-like casting. Aforesaid melt receivers 101 and 111 are of a rectangular configuration, each including a pair of side walls 101*a* or 111*a*, as the case may be, disposed parallel to the path of casting withdrawal, and a rear wall 101*b* or front and rear walls 111*b*, 111*b*, as the case may be, disposed in rectangular relation to the withdrawal path.

Such conventional melt receiver is held stationary at a specified position and, therefore, it has a drawback that a casting drawn is often liable to break-out. The cause of such break-out may be explained as follows. A wall shell is formed at a corner portion defined between the movable mold and either one of the side walls or the front or rear wall, and it tends to grow. A grown wall shell adheres to a casting shell formed on the movable mold through solidification of molten metal and tends to pull the casting shell away from the direction of drawing, with the result that the casting shell is broken at a relatively thin portion thereof. Again, such wall shell adheres to the casting shell until such breaking occurs. This process of adhering and breaking is repeated again and again, with the result that the casting shell is not constant in thickness, being thus liable to break-out at its relatively thin and weak portions.

DISCLOSURE OF THE INVENTION

The present invention has as its primary object the provision of an apparatus for continuous casting of a thin metallic plate, which prevents to the maximum possible extent the possibility of a wall shell adhering to the casting shell being formed.

In order to accomplish this object, the invention provides an apparatus for continuous casting of a thin metallic plate which includes a movable mold arranged for movement in a specified direction, and melt receiving wall means disposed on the movable mold for storing molten metal in cooperation therewith, whereby molten metal within the wall means, through its contact with the surface of the movable mold, will be cooled and formed into a casting shell, said casting shell being drawn by the movable mold in the form of a thin metallic plate, said apparatus being characterized in that at least the lower end portion of said melt receiving wall means is movable along the withdrawal path of the casting shell, and in that mover means are provided for moving the lower end portion of the melt receiving wall means.

According to such arrangement, it is possible to inhibit growth of a wall shell formed on the surface of the melt receiving wall means by moving (e.g., vibrating at the rate of 0.5 m/min. or more) the lower end portion of the melt receiving wall means, or more specifically, of a wall thereof perpendicular to the path of casting withdrawal, during casting operation, so that the casting may not be restrained. It is also possible, by moving walls parallel to the withdrawal path of the casting, to prevent a wall shell formed on the wall surface of the melt receiving means from adhering to the casting shell, so that the casting will be free from surface unevenness and not liable to break-out.

In one preferred embodiment of the invention, a movable mold comprises a pair of drive rollers, front and rear, and a belt-like mold trained endlessly around the drive rollers; and melt receiving wall means comprise a pair of side walls parallel to the path of casting-shell withdrawal, and a rear wall disposed between the rear ends of the side walls and in perpendicular relation to said path of withdrawal and which is movable in said path of withdrawal.

According to this arrangement, molten metal is formed into a casting shell successively as it is cooled on the surface of the belt-like mold and the casting shell is continuously drawn by the the mold in the form of a thin metallic plate as the mold moves forward. Since the rear wall of the melt receiver is moved in the direction of the casting being drawn, a wall shell formed on the rear wall is not likely to grow so large as to restrain the casting shell. Further, by using a vibrator as means for moving the rear wall, it is possible to positively prevent growth of such wall shell.

Another preferred embodiment of the invention comprises strip means wrapped round the entire periphery of the belt like mold at positions corresponding to those at which the pair of side walls are seated, said strip means constituting the lower end portion of the movable melt-receiving wall means.

According to this arrangement, it is possible to prevent the side edge portions of the casting shell from being restrained by a wall shell, since the strip means are movable along with the mold.

In another preferred embodiment of the invention, the melt receiving wall means comprise a pair of first side walls parallel to each other and a pair of second side walls disposed in rectangular relation to the side walls and parallel to each other, and the movable mold comprises a pair of rotatable rolls disposed along the respective lower ends of the second side walls and in parallel relation to each other; and movable circumferential strips which constitute the respective lower end portions of the first side walls are disposed over the respective outer peripheries of the rolls and at positions corresponding to those at which the first side walls are respectively seated.

According to this arrangement, molten metal is solidified into a casting shell sequentially as it is cooled by the pair of rolls, and is continuously drawn in the form of a thin metallic plate. In this process of operation, the circumferential strips as a part of the melt receiver are moved along the withdrawal path of the casting, and therefore a wall shell formed on each of the first side walls is not likely to grow so large as to restrain the casting shell.

BRIEF DESCRIPTION OF THE DRAWINGS

FIGS. 1 through 5 illustrate a first embodiment of the invention: FIG. 1 is a general view in section; FIG. 2 is a view taken in the direction of the arrows along line I—I in FIG. 1; FIG. 3 is a section showing a vibrator; FIG. 5 is a fragmentary enlarged view in section showing a modified way of wall vibration.

FIG. 6 is a general sectional view; FIG. 7 is a view showing the arrangement of a vibrator system; FIG. 8 is a graphic representation showing movement of a rear wall; FIG. 9 is a diagram showing relationships between casting speed and stroke length for different control patterns; FIG. 10 is a graphic view showing relationship between casting speed and vibration frequency; FIG. 11 is a control time chart for a servo valve; and FIG. 12 is a flow diagram of arithmetic operation.

FIG. 13 is a longitudinal sectional view; FIG. 14 is an enlarged perspective view showing a belt-type mold; FIG. 15 is an enlarged view in perspective showing strip means; FIG. 16 is a view taken in the direction of the arrows along line II—II in FIG. 15; FIG. 17 is a view taken in the direction of the arrows along line III—III in FIG. 16; FIG. 18 is a view taken in the direction of the arrows along line IV—IV in FIG. 13; and FIG. 19 is an enlarged view showing key portions in FIG. 13.

FIG. 20 is a persoective view showing a mold; FIG. 21 is a general view in section; FIG. 22 is a fragmentary sectional view; FIG. 23 is a side view showing circumferential strips; and FIGS. 24~26 are sectional views explanatory of certain aspects of operation.

FIG. 27 is a general view in section showing a fifth embodiment of the invention.

FIG. 28 is a sectional general view showing a sixth embodiment of the invention.

FIGS. 29 and 30 are sectional views illustrating prior-art apparatuses.

DESCRIPTION OF EMBODIMENTS

Figure 4A:
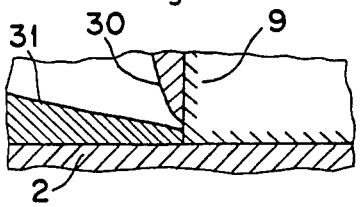
FIGS. 4*a*–4*e* are an explanatory representation showing effects of vibration on a wall.

The first embodiment of the invention will now be described with reference to the accompanying drawings.

In FIGS. 1 and 2, a movable mold comprises a pair of drive rollers 1A, 1B, front and rear, a belt-like mold 2 trained endlessly around the drive rollers 1A, 1B, a cooling box 3 disposed along the underside of a withdrawal path portion of the endless mold 2, and a support member 4 for supporting the cooling box 3. The withdrawal path portion of the mold 2 is moved forward as indicated by arrow A. On the withdrawal path portion of the mold 2 there is disposed a melt receiver 5 which temporarily stores molten metal in cooperation with the mold 2. Molten metal in the melt receiver 5 is cooled and solidified on the surface of the mold 2 and is thus formed into a casting shell. The casting shell, as it is so formed, is continuously withdrawn by the moving mold 2 in the forward direction A. A thin metallic plate is thus produced. Aforesaid melt receiver 5 is back and forth movably supported on the upper side of the mold 2 and along the withdrawal path of a casting shell, and is provided with an anti-lift device for preventing the melt receiver 5 from lifting off the surface of the mold 2 and also with a vibrator 7 for vibrating (moving back and forth) the melt receiver 5 along the withdrawal path. The melt receiver 5 comprises a pair of side walls 8A, 8B disposed parallel to the withdrawal path, and a rear wall 9 disposed in rectangular relation to the withdrawal path and which connects the rear ends of the side walls 8A, 8B. The anti-lift device 6 comprises arm members 10A, 10B extending outwardly from the respective outer surfaces of the side walls 8A, 8B and having projections 11A, 11B at their respective front ends, guide members 12A, 12B disposed at both ends of the support member 4 and having guide grooves 13A, 13B respectively for guiding the projections 11A, 11B so as to allow them to slide upward and downward and along the withdrawal path, bolts 14A, 14B extending respectively through both end portions of the support member 4 and further through the arm members 10A, 10B, and compression springs 16A, 16B interposed respectively between the arm members 10A, 10B and disc members 15A, 15B secured to the corresponding top ends of the bolts 14A, 14B. The melt receiver 5 is held by the compression springs 16A, 16B against the mold 2. It is noted that through-holes (not shown) provided in the support member 4 and in the arm members 10A, 10B are so large or elongate as to permit back and forth movement of the side walls 8A, 8B and of the rear wall 9. The vibrator 7, as FIG. 3 illustrates, comprises a support bracket 17 supported on the support member 4 or on the rear wall 9, a guide rod 19 which is held in a holding member 18 mounted to the support bracket 17 and which is slidable along the path of casting withdrawal, a connecting member 20 for connecting one end of the guide rod 19 to the rear wall 9, an actuator 21 connected to the other end of the guide rod 19, a weight 22 connected to the actuator 21 for augmenting vibrational force therefrom, and a regulating device 23 for regulating the amplitude of vibrational strokes of the guide rod 19. The regulating device 23 comprises a regulating plate 24 mounted to the support bracket 17 and fitted over a small diameter portion 19*a* of the guide rod 19, belleville springs 25A, 25B fitted over said small diameter portion 19*a* at both sides of the regulating plate 24, and a holding member 26 for holding the one belleville spring 25A located at one end side of the guide rod 19. For adjustment of aforesaid vibrational stroke, the belleville springs 25A, 25B are adjusted in degree of compression. The actuator 21 may be one which utilizes the reciprocating motion of a piston, or kinetic energy available from rotation of an eccentric weight.

Nextly, operational aspects of the above described embodiment will be explained.

Figure 4B:
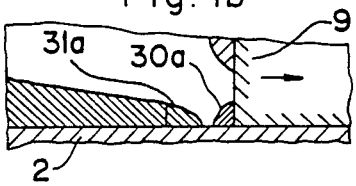
Figure 4C:
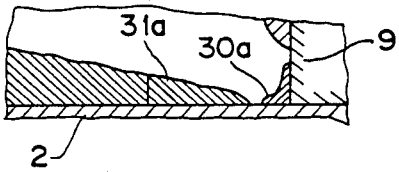
Figure 4D:
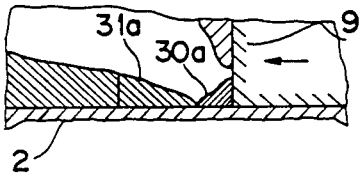
Figure 4E:
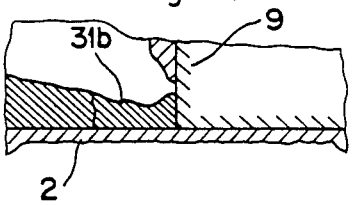

As FIG. 1 shows, molten metal 28 is poured into the melt receiver 5 through a ladle 27 and water is introduced into the cooling box 3. The melt receiver 5 is vibrated by the vibrator 7 through the rear wall 9. As the mold 2 is moved in the direction of the arrow A, a casting 29 is continuously drawn in the form of a thin metallic plate. The condition of shell formation at a corner portion defined between the rear wall 9 and the mold 2 during such casting operation is explained with reference to FIGS. 4a–4e. First, at FIG. 4a where the rear wall 9 has moved forward as shown, a wall shell 30 and a casting shell 31 are formed on the rear wall 9 and the mold 2 respectively. At FIGS. 4b and 4c where the rear wall 9 has moved slightly backward as shown, the casting shell 31 is slightly away from the rear wall 9 and a minor wall shell 30a and a minor casting shell 31a are newly formed as shown. Now, at FIGS. 4d and 4e where the rear wall 9 has moved forward, the minor wall shell 30a and the minor casting shell 31a are compressed so that a grown casting shell 31b is formed. Since the rear wall 9 is vibrated along the withdrawal path during casting withdrawal operation, such minor shell 30a formed at the corner portion is separated from the rear wall 9 in this way. Therefore, the difficulty experienced with the prior art that a casting shell 31 is broken by being restrained by a wall shell can be effectively overcome. Presumably, aforesaid separation of such minor wall shell 30a may be attributable to the fact that columnar crystal branches growing on the wall surface are broken through vibration. Elimination of wall shells which may restrain a casting shell results in improved casting quality, reduced surface roughness of castings and finer wrinkles (the term "wrinkle" corresponds to oscillation mark) on casting shells. Factors such as vibration frequency, vibrational stroke, and casting speed are related to one another. The effect of vibration on the surface characteristics of castings will be greater as the vibration is of higher frequency and of smaller stroke.

Figure 5:
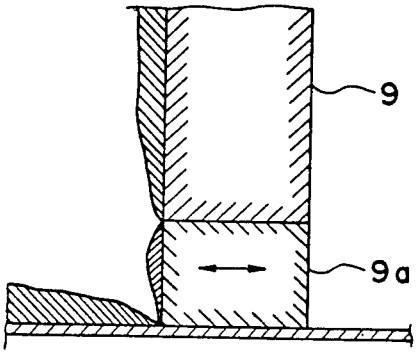

In the above described embodiment, it is arranged that the entirety of the melt receiver is vibrated. Alternatively, only the lower end portion 9a of the rear wall 9 may be vibrated as FIG. 5 shows.

Nextly, a second embodiment of the invention will be described with reference to the accompanying drawings.

A major feature of the second embodiment is a vibrator system for vibrating a melt receiver. Therefore, components identical with those of the first embodiment are designated by same reference numerals, and description of them is omitted.

Figure 6:
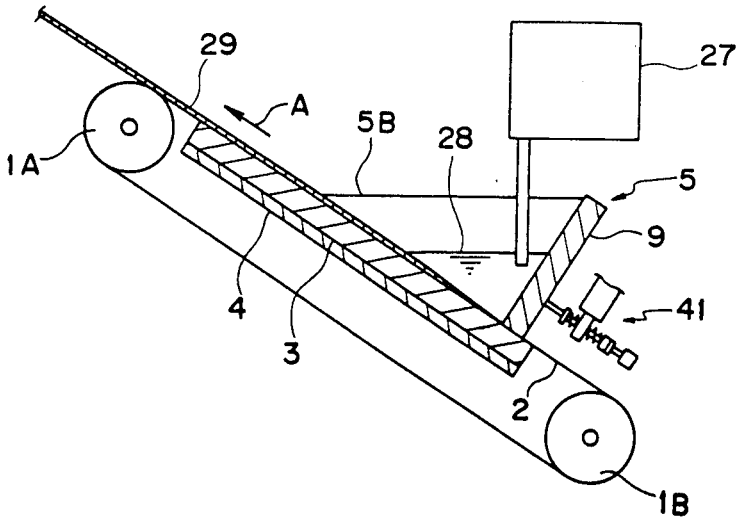
FIGS. 6~12 illustrate a second embodiment of the invention.
Figure 7:
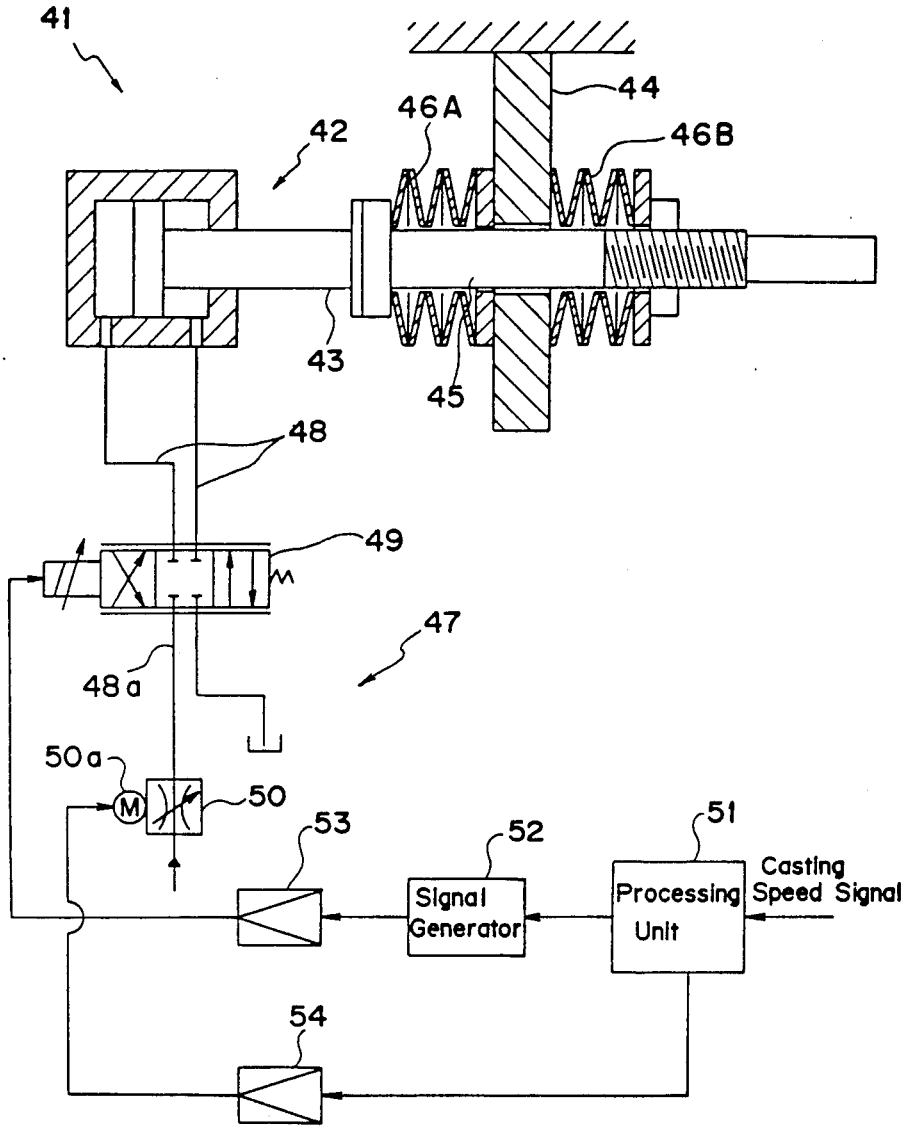

As FIGS. 6 and 7 illustrate, the vibrator system 41 in this embodiment comprises a single rod cylinder device 42, a connecting rod 45 which connects between a piston rod 43 of the cylinder device 42 and a rear wall 9 of a melt receiver 5 and which is fitted through and supported by a support bracket 44 mounted to a support member 4 or melt receiver 5, a pair of compression springs 46A, 46B mounted on the connecting rod 45 at both sides of the support bracket 44 for urging the connecting rod 45 toward a specified neutral position, and a control unit 47 for controlling vibration of the rear wall 9 of the melt receiver 5 through the cylinder device 42. The control unit 47 comprises a hydraulic pipe line 48 for supplying hydraulic oil to the cylinder device 42, a servo valve 49 disposed at a mid-point of the hydraulic line, a flow control valve 50 disposed on a hydraulic oil supply line 48a located on the upstream side of the servo valve 49, an arithmetic operation unit 51 for transmitting control signals to the servo valve 49 and the flow control valve 50, a signal generator 52 and a drive amplifier 53, both disposed at interemediate points on a signalling route from the arithmetic operation unit 51 to the servo valve 49, and a drive amplifier 54 disposed at a mid-point on a signalling route from the arithmetic operation unit 51 to the flow control valve 50. The arithmetic operation unit 51 receives a cast speed signal, calculates a corresponding speed of movement of and a corresponding volume of stroke of the piston rod 43, and issues control signals to the servo valve 49 and the flow control valve 50 on the basis of values so calculated.

Operational features of the second embodiment will now be explained.

Figure 8:
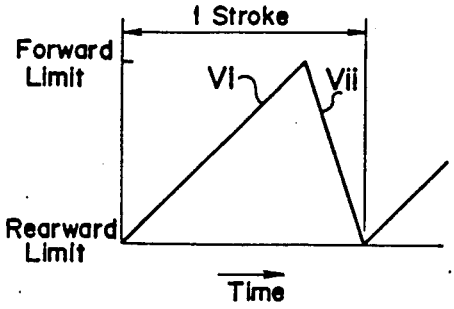

As FIG. 6 shows, molten metal 28 is poured into the melt receiver 5 through the ladle 27 and water is introduced into the cooling box 3. The melt receiver 5 is vibrated by the vibrating device 41 through the rear wall 9. As the mold 2 is moved in the direction of the arrow A, a casting 29 is continuously drawn in the form of a thin metallic strip. In this connection, the rear wall 9 is moved by the cylinder device 42 in such way as FIG. 8 illustrates. When the rear wall 9 is moved forward, the speed of its movement is so controlled as to coincide generally with the speed of movement of the mold 2, that is, the rear wall 9 is moved relatively slow (condition (vi)) so that the casting shell formed on the mold 2 may be prevented from being crushed by a wall shell formed on the surface of the rear wall 9. When the rear wall 9 is moved backward, it is retreated fast [condition (VIII)] so that the wall shell formed on the surface of the rear wall 9 may be as much less thick as possible. Now, the relationship between vibration frequency (H) of the rear wall 9 and speed of movement (casting speed) (V) of the mold 2 is expressed approximately by the following equation: (1)

$$V \times a = \tfrac{1}{2} \times S \times H \qquad (1)$$

Where

S : stroke, a : factor according to casting condition.

In the above equation (1), a is greater than 1 in one case. In another case, a is between 0 and 1. The former case represents a condition under which the casting may be crushed by a wall shell, whereas the latter case represents a condition under which the casting is free from the possibility of being crushed. Normally, therefore, factor a is between 0 and 1.

Now, the manner of control in actual operation will be explained.

Figure 9:
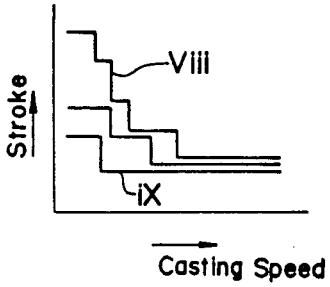

A signal for speed of movement of the mold 2 or casting speed is first received into the arithmetic operation unit 51, in which the desired amount of stroke of the piston rod 43 is determined. Such determination is made according to various different patterns preset considering such factors as type of metal casting, and tapping temperature of ex-furnace metal. Three types of such patterns are showm in FIG. 9. These patterns indicate relationships between casting speeds and strokes in the case where factor a in the above given equation (1) is set at a given value, 0.5 for example. Pattern (viii), for example, indicates that the type of metal is ordinary carbon steel and that the temperature of molten metal is relatively high. Pattern (ix) indicates that the type of metal is an alloy steel or a high-quality steel and that the temperature of molten metal is relatively low.

Now, it is assumed, for example, that factor a is set at 0.5; casting speed is set at 1.2 m/min.; and amount of stroke is set at 0.5 mm. Then, vibration factor (H) is determined according to the following equation (2) [a modification of equation (1)]:

$$H = \frac{2 \times a \times V}{S} \quad (2)$$

$$= \frac{2 \times 0.5 \times 20}{0.5}$$

$$= 40 \text{ 1/sec}$$

Figure 10:
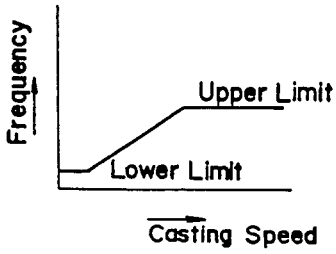

Number of vibration increases in proportion to casting speed; it is noted, however, that as FIG. 10 shows, upper and lower limits of vibration frequency are preset.

When number of vibration (which corresponds to speed of piston rod movement) has been thus determined, the amount of oil to be supplied to the cylinder device 42 is calculated.

It is assumed, for example, that the inner diameter of the cylinder is 40 mm and that the diameter of the rod is 28 mm. It is noted in this connection that the inner diameter of the cylinder must be large enough to overcome a load representing the total of slide resistance of the rear wall 9 of the melt receiver 5 and pressure from the molten metal. The oil requirement for one reciprocation of the piston rod 43, i.e., for one cycle of rod movement, is thus calculated as follows:

$$\frac{\pi}{4} \times 40^2 \times 0.5 + \frac{\pi}{4}(40^2 - 28^2) \times 0.5 = 936 \text{ mm}^3$$

Figure 11:
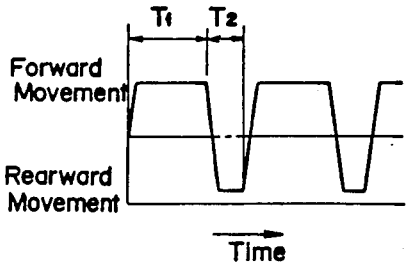
Figure 12:
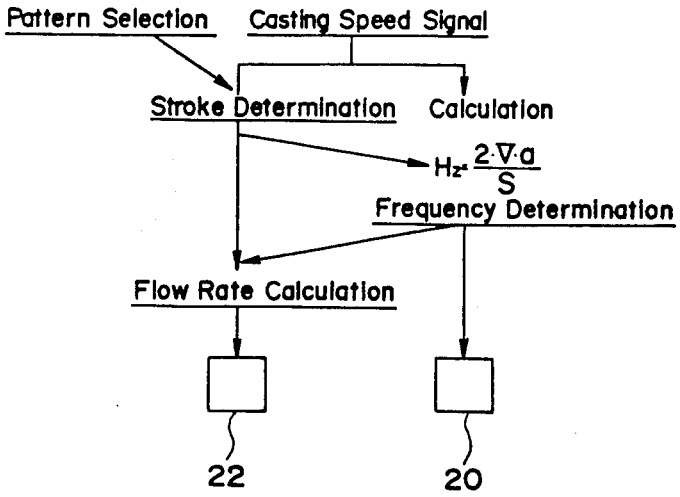

This value corresponds to 2.246 l/min. in terms of per-minute oil requirement. A signal for aforesaid number of vibration is transmitted to the signal generator 52, which in turn issues a specified signal wave form, for example, one shown in FIG. 11, to the servo valve 49 through the drive amplifier 53. In FIG. 11, T1 represents push stroke time and T2 represents pull stroke time. Also, a signal for aforesaid oil requirement is transmitted to a drive motor 50*a* of the flow control valve 50 through the drive amplifier 54. It is noted in this connection that since the cylinder device is of single-rod type, flow rate need not be differentiated between push-stroke time and pull-stroke time; difference in rod areas involved will result in pull-push time speed difference. In the case where the cylinder is of double-rod type, it is necessary to carry out flow control individually for push time and pull time, through control signals from the arithmetic operation unit 51. A control flow for above described process is shown in FIG. 12.

When a change from the condition preset as aforesaid occurs in casting speed, the speed of movement of the piston rod 43 and the oil requirement for piston rod movement are automatically changed according to the casting speed change.

Nextly, a third embodiment of the invention will be described with reference to the accompanying drawings.

Figure 13:
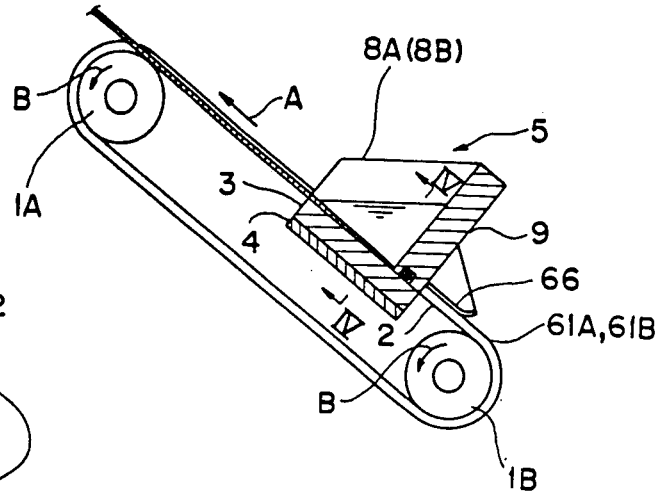
FIGS. 13~19 illustrate a third embodiment of the invention.
Figure 14:
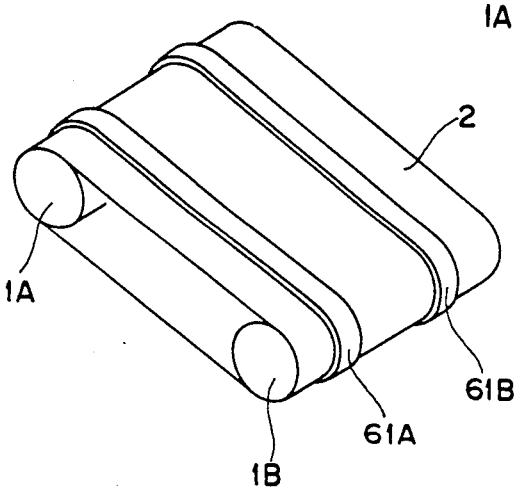
Figure 15:
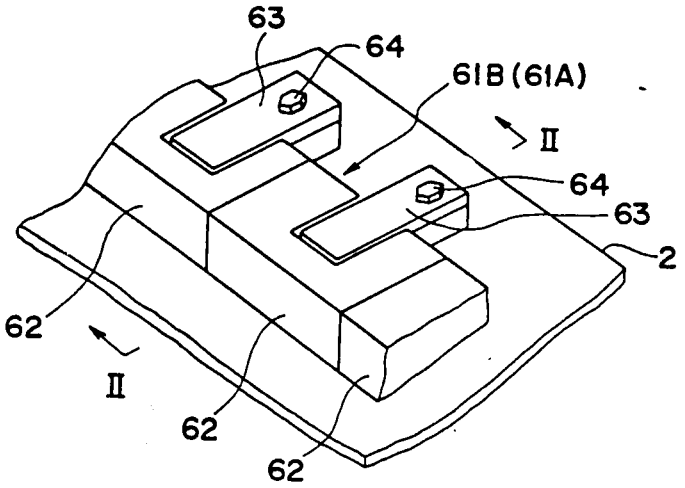
Figure 17:
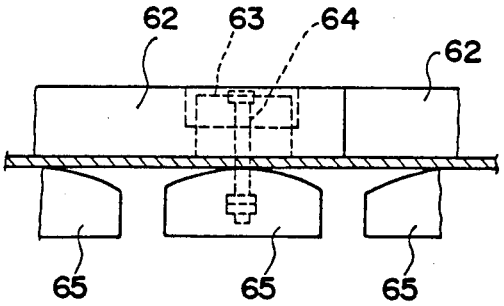
Figure 16:
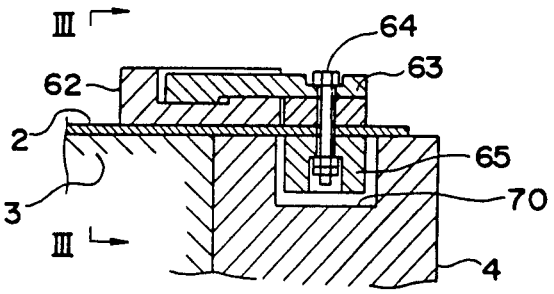
Figure 18:
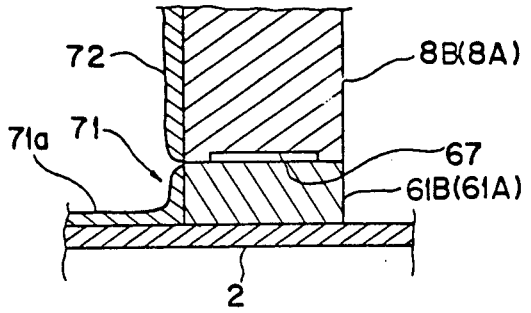
Figure 19:
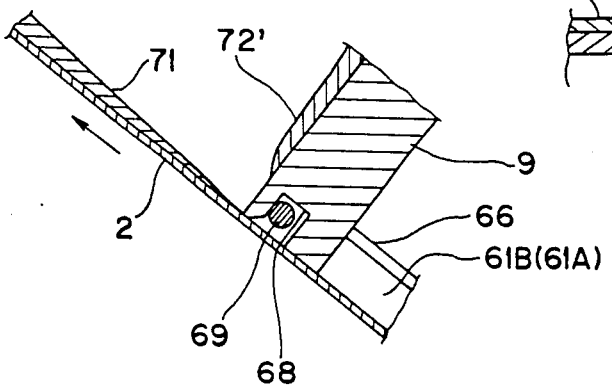
Figure 21:
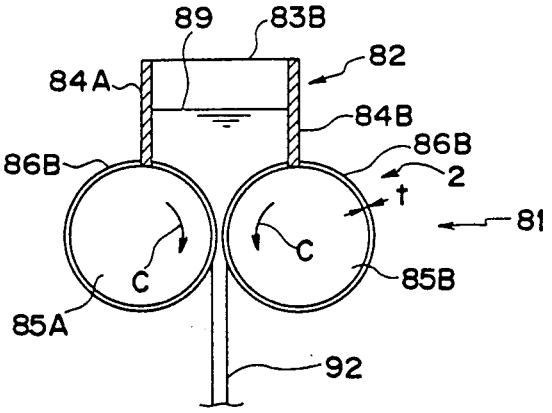
FIGS. 20~26 illustrate a fourth embodiment of the invention.

The movable mold in this third embodiment is a belt-like mold similar to the one employed in the first embodiment. Therefore, detailed description of the mold is omitted. In FIG. 13, a melt receiver 5 comprising a pair of side walls 8A, 8B parallel to the path of casting withdrawal and a rear wall 9 rectangular to the withdrawal path is disposed on the upperside of the belt-like mold 2. Usually, the melt receiver 5 is constructed of a refractory having high heat insulating properties. As FIG. 14 illustrates, a pair of strip means 61A, 61B which constitute base portions for the side walls 8A, 8B are wrapped around the periphery of the mold 2 at positions corresponding to those of the side walls 8A, 8B. The strip means 61A, 61B, therefore, depend for their movement upon the mold 2. The strip means 61A, 61B have a height not smaller than casting thickness and a width equal to that of each side wall 8A, 8B. They are constructed of a ceramic material or a refractory so that their cooling capability is smaller than that of the mold surface and greater than that of the side walls 8A, 8B. As may be seen from FIGS. 15~17, the strip means 61A, 61B each consists of a number of segments 62 divided and extending in the direction of movement, each of the segments 62 being fixed to the belt-like mold 2 through presser plates 63, mounting bolts 64, and mounting members 65. Such partition into segments 62 is intended to facilitate turning at curve portions around the drive rollers 1A, 1B. On the inner side surface of each segment 62 located on the casting shell side there are formed a large number of roughened portions in order to provide increased frictional resistance to the casting shell. A guide plate 66 is mounted to the back of the rear wall 9 for guiding each segment 66 smoothly into abutment with the underside of the corresponding side wall 8A, 8B after each round trip of the segment 66. Further, it is so arranged that the individual segments 62 are cleaned by a scraper (not shown), for example, after each round trip and before their access to the guide plate 66. Furthermore, as FIG. 18 shows, each of the side walls 8A, 8B is provided with a cutout 67 on its underside so that heat from the side wall 8A, 8B may be prevented from being transferred to the corresponding strip means 61A, 61B. As FIG. 19 shows, a heater 69 is provided in a groove 68 on the underside of the rear wall 9. The support member 4 for supporting the drive rollers 1A, 1B and the belt-like mold 2 is formed with guide grooves 70 for allowing movement of the mounting members 65.

Operational aspects will now be explained.

When the drive rolls 1A, 1B are in rotation in the direction of the arrow B, the belt-like mold 2 and the strip means 61A, 61B move together into cooperation with the melt receiver 5. Upon their first contact with molten metal, a thin casting shell 71 is formed as FIG. 18 shows. Now, if individual wall shells 72 formed on the side walls 8A, 8B grow and tend to catch up with the thin casting shell 71, the strip means 61A, 61B each having sufficient thickness prevent them from reaching a major portion 71*a* of the casting shell 71; and thus the wall shells 72 break adjacent the moving strip means 61A, 61B. Even if the wall shells 72 show a behavior to contact the casting shell 71, the latter is separated from the wall shells 72, since the casting shell 71 is firmly held by the strip means 61A, 61B through the roughened portions. Further, since the cutout 67 provided on the underside of each side wall 8A, 8B prevents heat in the melt receiver 5 from escaping toward the belt-like mold 2, growth of wall shells 72 is retarded. The casting is cooled as it moves forward, and thus the casting shell 71 is allowed to have greater strength, thus becoming more unlikely to be captured by wall shells 72. In addition, as FIG. 19 shows, a wall shell 72' formed on the rear wall 9 is prevented from growth by the heater 69 disposed in the lower portion of the rear wall 9, so that the casting shell 71 is less liable to restraint.

Nextly, a fourth embodiment of the invention will be explained with reference to the accompanying drawings.

Figure 20:
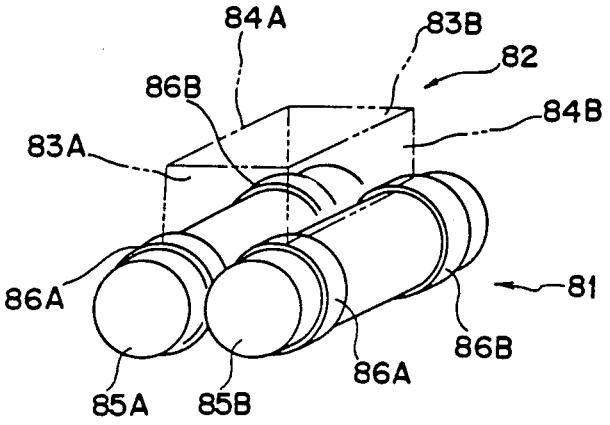
Figure 22:
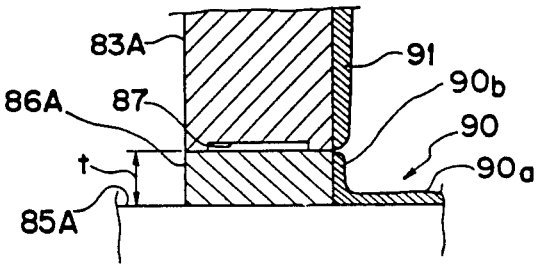
Figure 23:
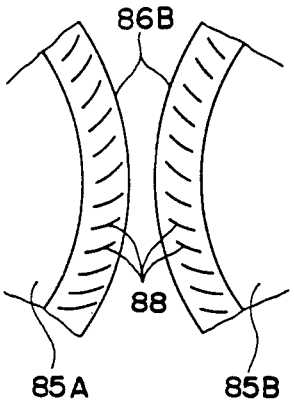

As FIG. 20 shows, the movable mold in this embodiment is a twin-roll type mold (hereinafter referred to as mold) 81; and a melt receiver 82 disposed above the mold is of a rectangular configuration in plan view. The melt receiver 82 comprises a pair of first side walls 83A, 83B parallel to each other, and a pair of second side walls 84A, 84B disposed in rectangular relation to the first side walls 83A, 83B and parallel to each other. The mold 81 comprises a pair of rolls 85A, 85B disposed under the second side walls 84A, 84B respectively along the length thereof, and parallel to each other. A thin metallic plate or sheet is continuously produced by a casting drawn downwardly through a clearance defined between the pair of rolls 85A, 85B. At positions corresponding to the first side walls 83A, 83B, the rolls 85A, 85B each has a pair of circumferential strips 86A, 86B wrapped therearound, which constitute bases for the first side walls 83A, 83B. The circumferential strips 86A, 86B are constructed of a refractory material having a specified thickness ( t ) and good heat conductivity, and are fixed by a ceramic adhesive to the respective rolls 85A, 85B. As FIG. 22 shows, the circumferential strips 86A, 86B are of about the same width as the first side walls 83A, 83B, and the first side walls 83A, 83B, which are slidably positioned, are each provided with a cutout 87 on the underside thereof so that heat from the melt receiver 82 is prevented from being transferred to the strips 86A, 86B. Further, a multiplicity of grooves 88 extending along a cycloidal curve are formed on the side of each circumferential strip 86A, 86B on the molten-metal side. A large number of roughened portions may be provided instead of grooves 88.

Operational aspects will now be explained.

Figure 24:
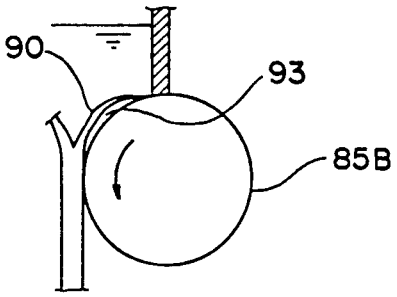
Figure 25:
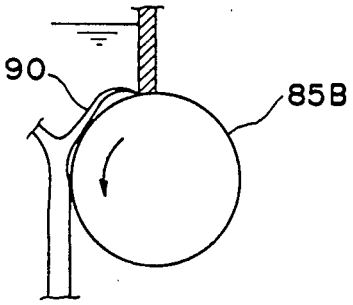
Figure 26:
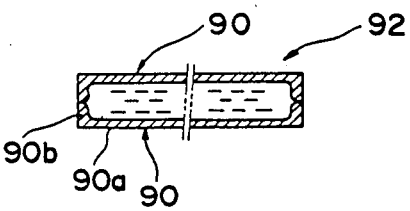

When the rolls 85A, 85B are in rotation in the direction of the arrow C, the circumferential strips 86A, 86B advance in concert with the rolls 85A, 85B into the melt receiver 82 through the second side walls 84A, 84B. Then, they make their first contact with molten metal 89, and as FIG. 22 shows, a thin metallic plate or sheet 90 is formed. Now, if individual wall shells 91 formed on the first side walls 83A, 83B grow and tend to catch up with the thin casting shell 90, the circumferential strips 86A, 86B having sufficient thickness prevent their reaching a horizontal portion 90*a* of the casting shell 91; and the wall shells 90 are broken adjacent the rotating strips 86A, 86B. Even if the wall shells 91 show a behavior to contact the casting shell 90, the latter is separated from the wall shells 91, since the casting shell 90 is firmly held by the strips 86A, 86B through the grooves 88. Further, since the cutout 87 provided on the underside of each of the first side walls 83A, 83B prevents heat in the melt receiver 82 from escaping toward the rolls 85A, 85B, growth of wall shells 91 is retarded. The casting 90 is cooled through the rolls 85A, 85B as it is moved forward, and thus the casting 90 is allowed to have greater strength, becoming more unlikely to be captured by wall shells 91. Now, when the horizontal portion of a casting shell 90 has greater strength, it means that the casting shell 90 is less liable to breakout; but usually the casting shell is likely to be deformed in such way as it will separate from the rolls 85A, 85B. As may be seen from FIG. 24, such tendency is often attributable to irregularities involved in shell formation; and when the casting shell 90 contracts on the drum surface, it is always deformed with a radius smaller than the circular arc of the rolls 85A, 85B under the influence of temperature distribution in the thicknesswise direction of the shell. Such deformation results in the formation of a clearance 93, which retards shell growth. All this contributes to shell irregularities, and if such condition as shown in FIG. 25 is reached, a casting shell just formed may lift out of position and may be remelted by fresh molten metal. This prevents production of a continuous casting shell and also leads to breakout. The circumferential strips 86A, 86B are effective in preventing such lifting behavior, serving as anti-lift devices. Further, in the case of a twin roll mold of above described type being employed, where as FIG. 26 shows, casting shells 90, 90 formed on the rolls, right and left, meet between the rolls into one sheet of casting 92. As they pass through the clearance between the rolls, however, if solid phase portions of the respective casting shells interfere with each other and solidify into a casting, it is likely that in the case of alloy steel in particular, negatively segregated materials are present in the interior of the casting, which means deteriorated product quality. In order to avoid such unfavorable development, it is necessary that the interior of the casting still remains unsolidified when the casting is between the rolls. Further, it is necessary that the total thickness of the two casting shells 90 at vertical portions 90*b* thereof is greater than the size of the clearance between the rolls. In order to produce shells of such configuration, the vertical portion 90*b* of each shell should be greater in thickness than the horizontal portion 90*a*. In this embodiment, it is so arranged that the vertical portion 90*b* is positively protected by the circumferential strips 86A, 86B from wall shell 91 and is positively allowed to grow.

A fifth embodiment will be explained with reference to the accompanying drawings. While only circumferential strips 86A, 86B are movable in the fourth embodiment, the fifth embodiment is such that as FIG. 27 shows, lower end portions 94A, 94B of the second side walls 84A, 84B between the circumferential strips 86A, 86B are adapted to be moved by vibrators 95A, 95B in the direction of rotation of the rolls 85A, 84B.

A sixth embodiment is such that as FIG. 28 shows, only the lower end portions 94A, 94B of the second side walls 84A, 84B are adapted to be by vibrated by vibrators 95A, 95B.

The vibrators 95A, 95B in the fifth and sixth embodiments are of the same type as those employed in the first and second embodiments.

Whereas strip means or circumferential strips, as the case may be, are fixed to the movable mold in the above described embodiments, strips in a seventh embodiment are not fixed to the movable mold, but are movable at same speed as the movable mold.

What is claimed is:

1. An apparatus for continuous casting of a thin metallic plate which includes a movable mold arranged for movement in a specified direction, and melt receiving wall means disposed on the movable mold for storing molten metal in cooperation therewith, whereby molten metal within the wall means, through its contact with the surface of the movable mold, will be cooled and formed into a casting shell, said casting shell being drawn by the movable mold in the form of a thin metallic plate, said apparatus being characterized in that at least the lower end portion of said melt receiving wall means is movable along the moving direction of the movable mold, and in that vibrating means are provided for oscillating the lower end portion of the melt receiving wall means along the moving direction of the movable mold.

2. An apparatus as set forth in claim 1 wherein said melt receiving wall means comprise a pair of first side walls parallel to each other, and a pair of second side walls disposed in rectangular relation to the first side walls and parallel to each other, and said movable mold comprises a pair of rotatable rolls disposed along the lower edges of said pair of second side walls and parallel to each other, and the lower end portions of said pair of the second side walls are arranged movably along said moving direction.

3. An apparatus as set forth in claim 1 wherein said movable mold comprises a pair of drive rollers, front and rear, and a belt-like mold trained endlessly around the drive rollers; and said melt receiving wall means comprise a pair of side walls parallel to the moving direction of the belt-like mold, and a rear wall disposed between the rear ends of the side walls in perpendicular relation to said moving direction; and at least the lower end portion of said rear wall is movable along said moving direction.

4. An apparatus as set forth in claim 3 wherein said vibrating means comprise a support bracket supported on the melt receiving wall means, a guide rod held in a holding member mounted to the support bracket and slidable along the moving direction of the movable mold, a connecting member for connecting one end of the guide rod to said lower end portion of the rear wall, an actuator connected to the other end of said guide rod, and regulating means fitted in said guide rod for regulating the amount of vibration stroke of the guide rod.

5. An apparatus as set forth in claim 4 wherein said regulating means comprise a regulating plate mounted to said support bracket and fitted over said guide rod, and belleville springs fitted over the guide rod at both sides of the regulating plate for reducing transfer force of the guide rod.

6. An apparatus as set forth in claim 3 wherein said vibrating means comprise cylinder means connected to said lower end portion of the rear wall, a hydraulic pipe line for supplying hydraulic oil to the cylinder device, a servo valve disposed at an intermediate point of the hydraulic pipe line, a flow control valve disposed on the hydraulic oil supply side of said hydraulic pipe line, and an arithmetic operation unit which receives a signal for casting speed and calculates transfer speed and amount of stroke of the piston rod of said cylinder means and which issues control signals to said servo valve and flow control valve on the basis of the calculated values.

7. An apparatus for continuous casting of a thin metallic plate which includes a movable mold arranged for movement in a specified direction, and melt receiving wall means disposed on the movable mold for storing molten metal in cooperation therewith, whereby molten metal within the wall means, through its contact with the surface of the movable mold, will be cooled and formed into a casting shell, said casting shell being drawn by the movable mold in the form of a thin metallic plate, said apparatus further including strip means which extend from the lower end portions of said melt receiving wall means and are parallel to the moving direction of the mold, and means for moving said strip means simultaneously with said movable mold.

8. An apparatus as set forth in claim 7 wherein said movable mold comprises a pair of drive rollers, front and rear, and a belt-like mold trained endlessly around the drive rollers; and said melt receiving wall means comprise a pair of side walls parallel to the moving direction of the belt-like mold and a rear wall disposed perpendicular to said moving direction between the rear ends of the side walls, and said strip means, which constitutes the lower end portions of said pair of side walls, are wrapped over the periphery of said belt-like mold at corresponding positions to said side walls.

9. An apparatus as set forth in claim 7 wherein said melt receiving wall means comprise a pair of first side walls parallel to each other, and a pair of second side walls disposed in rectangular relation to the first side walls and parallel to each other, wherein said movable mold comprises a pair of rotatable rolls disposed along the lower edges of said pair of second side walls and parallel to each other, and said strip means are wrapped over the outer surfaces of said rolls at positions corresponding to said first side walls, said strip means constituting the lower ends of said pair of first side walls.

10. An apparatus as set forth in claim 9 wherein the lower end portions of the second side walls between the strip means are movable along the moving directions of the strip means, vibrating means being provided for oscillating along said moving direction the lower end portions of the second side walls.

* * * * *